United States Patent [19]

Wise

[11] Patent Number: 4,982,884

[45] Date of Patent: Jan. 8, 1991

[54] BACKPACK CARRIER ASSEMBLIES

[76] Inventor: Stephen A. Wise, King George St., #16, Jerusalem, Israel, 94229

[21] Appl. No.: 840,927

[22] Filed: Mar. 18, 1986

[51] Int. Cl.[5] ..... A45F 3/08

[52] U.S. Cl. ..... 224/211; 224/216; 224/197

[58] Field of Search ..... 224/153, 211, 262, 210, 224/212, 213, 215, 216, 261, 263, 150, 185, 197

[56] References Cited

U.S. PATENT DOCUMENTS 2,830,747 4/1958 Creste ..... 224/150

3,797,718 3/1974 Plant ..... 224/262

*Primary Examiner*—Renee S. Luebke

[57] ABSTRACT

Disclosed are backpack and carrier assemblies adapted to be worn by and partially supported or stabilized by the upper torso of the user. A pivotal coupling is provided with the backpack portion at or above the center of the gravity of the backpack so that the backpack is free to swing from side to side behind the hips of the user and to swing about the coupling. Low friction blocks, pads, rollers or surface are provided near the lower extremity of the backpack and between the backpack and the hip and pelvic region of the user in order to reduce frictional forces and facilitate the side-to-side movement.

27 Claims, 2 Drawing Sheets

BACKPACK CARRIER ASSEMBLIES

BACKGROUND OF THE INVENTION

1. Field of the Invention

The present invention relates generally to backpack and carrier assemblies.

2. Description of Prior Art

During normal walking and running, the shoulders and pelvis rotate in opposite directions. This relative counter-rotation results as each side of the pelvis follows its associated leg as that leg extends forward to begin a step. While that leg remains in place on the ground, it serves as a pivot about which the pelvis rotates as it carries the other leg and torso forward. The upper torso, in turn, remains oriented generally in the direction of forward movement; thus, there is a resulting opposing relative movement of pelvis to upper torso.

Relative to the torso, the pelvic movements are complex partial rotations in several planes, alternatively clockwise and counter-clockwise. The torso also operates as the counter balancing inertial mass against which connecting muscles pull in order to generate pelvic rotation, leg movement and thrust. The effectiveness of the torso as a counter-balancing mass is enhanced by coordinated swinging of the arms, choreographed so as to oppose pelvic rotation. Torso mass is further increased, and its effects amplified, by the additional mass of a loaded backpack carried by the shoulders and upper torso. The additional mass of a backpack load allows torso counter-movement to be shorter and still provide the appropriate counter-force to hip rotation.

Given the downward pull of gravity, backpack weight must be borne by generally upward-facing horizontal body surfaces. The shoulders are most commonly used for this purpose; thus, most backpacks have shoulder straps. An alternative or supplementary method is to transfer all or some of the load to a belt worn about the user's pelvic area. Weight thus transferred by the frame to the belt is passed on to the lower body through the hydraulic action of the belt in squeezing the pelvic area. Therefore, this soft area of the body is in effect squeezed into a relatively firm vertical column, the outer skin of which is gripped by the belt through friction. Inside this vertical column (which is composed of muscles, veins, arteries and internal organs), weight is transferred to the pelvis. Some weight also reaches the pelvis just below the skin surface which is not covered by muscles. Such squeezing has the unfortunate effect of interfering with both muscular flexion and blood flow to and from the legs and throughout the pelvic area.

In addition to the above-mentioned problems which belt squeeze causes in various soft tissues, most versions of the belt-and-frame backpack also tend to restrict pelvic rotation. While one can walk without rotating the pelvis, this type of movement is both awkward and tiring; each step is significantly shortened. In such a situation, the pelvis not only does not contribute its own additional extension to step length, but also the hip joint reaches its angular rotational limit early in the stride, as do the relative tendons, because of limited pelvic rotation about the associated transverse axis.

Even in a beltless backpack borne only by the shoulders, the relative counter-rotational movement discussed above during natural walking is hindered. Because the backpack is attached to and moves with the shoulders, its lower front-facing portion moves in a direction opposite to that of the lower rear-facing portion of the user's back. Given the "overhung" mechanics of a shoulder-supported backpack, the lower part of the backpack can press with considerable forward force against the lumbar region of the user. The result is that the combination of this friction with the opposing lateral directions of motion hinders the free rotational movement of the pelvis, and also causes jiggling of the backpack.

So-called "fanny" packs are particularly problematic. Such packs cause the user to suffer from the above-described squeeze problems by transferring all of the weight to a hip belt. But there is an additional problem with such packs caused by adding mass to the pelvic area. Given the relationship of mass to inertia and motion, the effectiveness of upper torso mass as an inertial stabilizer and counterbalance is reduced relative to the increased mass associated with the pelvis in such a "fanny" pack. Worse, the rotating pelvis must now propel the entire mass of the loaded pack, not only forward with the body as a whole, but also along the pelvis' own complicated path, which comprises alternating clockwise and counter-clockwise rotations and other movements in three dimensions.

Specific prior art backpack arrangements of interest are disclosed in the following U.S. Pat. Nos.: 3,033,431 to Henderson et al.; 3,114,486 to Flexman; 3,191,828 to Senne; 3,206,087 to Tyrrell; 3,254,816 to Gray; 3,282,483 to Babcock; 3,355,075 to Dean; 3,516,586 to Farnbach; 3,653,566 to Owens; 3,733,017 to Pletz; 3,831,827 to Olson; 3,889,859 to Joseph; 3,938,718 to Madison; 4,013,201 to Potter; 4,015,759 to Dreissigacker et al.; 4,099,657 to Zufich; 4,189,076 to Zufich; 4,194,656 to Zufich; 4,214,685 to Pletz; 4,303,186 to Ollinger; 4,369,903 to Wilkes; 4,479,595 to Opsal; and 4,504,002 to Hall.

SUMMARY OF THE INVENTION

In its broadest terms, the present invention contemplates the use of a backpack or carrier assembly utilizing a pelvic support (and which may also be supported by shoulder straps) but in which the mechanical coupling between the pelvic support and the backpack is well above the pelvic region in order to permit the bottom of the backpack to swing freely in accordance with the natural pelvic movements described above. Further, in accordance with the broad precepts of this invention, means are provided for avoiding, or at least reducing, the frictional contact between the bottom of the backpack and the lower back region of the user during side-to-side movement of the rear pelvic surface relative to the lower pack surface.

More specifically, the present invention contemplates a backpack or carrier assembly adapted to be worn by a user and comprising a backpack adapted to be at least partially supported or stabilized by the upper torso of the user and with a belt dimensioned to fit about the waist of the user. Means are provided for pivotably coupling the belt with the backpack at, or above the center of gravity of the backpack so that the backpack is free to swing from side to side behind the hips of the user and to swing about the pivotal coupling means. In one specific embodiment, the pivotal coupling means comprises a stave which extends vertically through the backpack and a pivot arm pivotally coupled to the stave above the center of gravity of the backpack along a single pivot axis that extends from front to rear through the user and backpack. In order to further enhance the ability of the backpack or carrier assembly to freely rotate with the complex motions of the pelvic region, the pivotal coupling of the arm at the waist encircling belt in one embodiment permits 360° of rotation.

In the preferred embodiment of the backpack assembly of the present invention, means are provided for limiting the amount of side-to-side swing of the backpack across the hip area of the user. In one specific arrangement, the swing limiting means comprises adjustable elastic bands which loosely extend from each side of the lower portion of the backpack and about the hips of the user.

Further in accordance with the preferred embodiment of the present invention, the vertical stave extending through the backpack, and the pivot arm, are both curved to comfortably conform to the spinal region of the user. The preferred embodiment of the backpack further includes a cross member across the top of the stave for supporting the backpack. A similar cross member at the lower extremity of the stave is provided with low friction means to reduce the friction resulting from contact and lateral counter-movement of the lower portion of the backpack relative to the lower back of the user. Thus, the combination of the pivotal mechanism which permits free hip movement between the waist-encircling belt and the backpack, together with the low friction contact means at the lower extremity of the backpack, allows the hips to follow a natural path while the pelvic region sustains part of the load of the backpack, all while providing low friction contact between the lower extremity of the backpack and the pelvic region. Suitable low friction mechanisms include teflon or silicone-type bearing surfaces, or roller-and-track mechanisms, as is more fully described below.

DETAILED DESCRIPTION OF THE PREFERRED EMBODIMENTS

Figure 1:
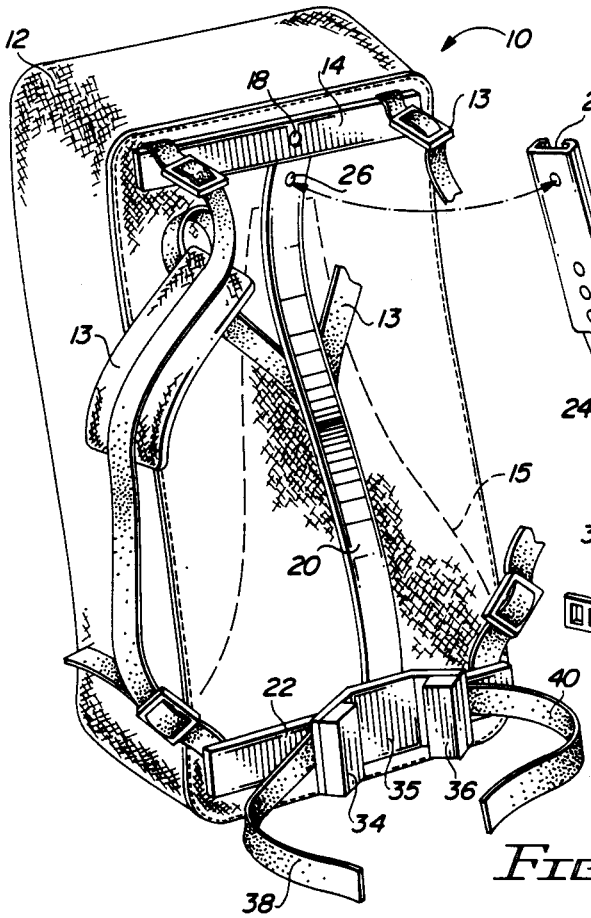
FIG. 1 is an elevation illustrating one embodiment of a backpack assembly in accordance with the present invention.
Figure 1:
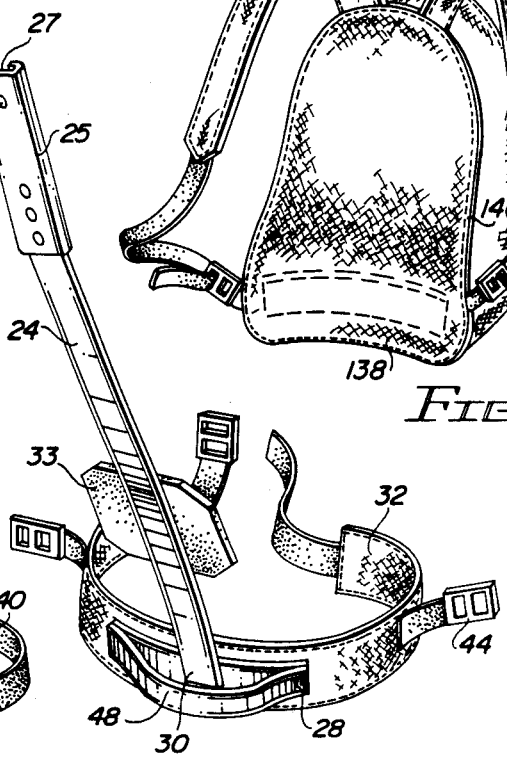
Figure 2:
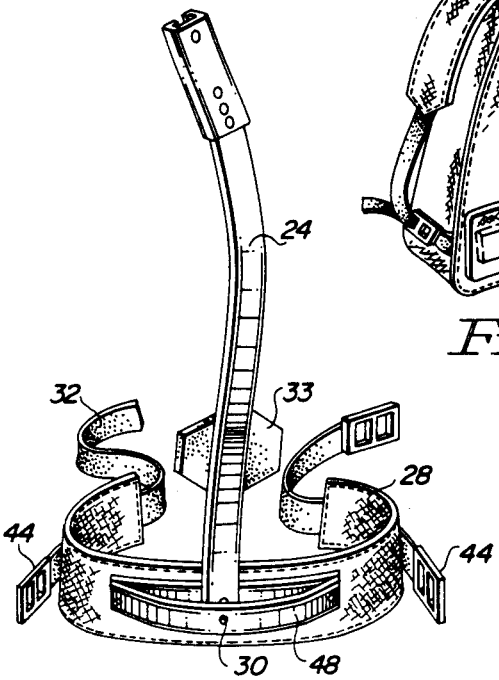
FIG. 2 is an elevation of a portion of the backpack assembly shown in FIG. 1.

Referring now to FIGS. 1 and 2, there is depicted a backpack assembly 10 in accordance with the present invention, including a backpack member 12. Typically, the backpack member 12 consists of a canvas or nylon fabric material which is sewn with seams into a configuration which permits the packing of clothing and other articles within the member 12.

The backpack member 12 is supported by a horizontal cross member 14 which may, for example, be sewn into the backpack member 12. A stiffener 15, shown by dotted lines, prevents objects in the pack 12 from protruding into the area between the user and the pack, thus avoiding any interference with the operation of the assembly.

The backpack assembly 10 is further provided with a vertical stave 20 which preferably conforms generally with the curvature of the spine of a typical user. The vertical stave 20 is fixed at its upper extremity along the cross member 14, and at its lower extremity near the bottom of the backpack member 12 and adjacent a cross member 22 extending horizontally therefrom.

A pivot arm 24 is pivoted at point 26 along the stave 20, and preferably above the center of gravity of the backpack member 12. A bracket 25 having a restricted track 27 permits limited sliding movement of the arm 24 in the vertical direction to permit adjustments as the user bends forward and backward, and to accommodate users of differing heights. The lower extremity of the pivot arm 24 is likewise pivoted omnidirectionally at its lower extremity at a ball pivot 30 to a waist-encircling belt 28. The belt 28 includes an adjusting strap 32 and side buckles 44 adapted to engage restraining belts 38 and 40, described more fully below. A lumbar pad 33 is mounted on the pivot arm 24 for the user's comfort, and to lift the entire rear portion of the belt assembly away from the user's buttocks.

As is shown in FIG. 1, the backpack assembly 10 is provided with low friction contact means in the form of teflon blocks 34 and 36 mounted on a plate 35 which is attached to the cross member 22. The blocks 34, 36 are adapted to engage a low friction plate 48 which extends horizontally about a portion of the rear periphery of the waist-encircling belt 28 (note FIG. 2). The swing-limiting elastic belts 38 and 40 engage in the buckles 44 on the outside of the waist-encircling belt 28.

As is shown in FIG. 1, the backpack assembly 10 is further provided with shoulder straps 13 and 15 which are adapted to be worn about the shoulders of the user to support or stabilize the pack.

In use, the shoulder straps 13 and 15 are placed over the shoulders of the user, and the waist-encircling belt 28 is secured in an appropriate manner around the hips and waist of the user. The swing-limiting belts 38 and 40 are likewise adjustably coupled at their extremities to buckles 44 in a rather loose fashion. Thereafter, as the user walks or runs in a normal fashion, the location of the pivot point 26 coupling the pivot arm 24 to the stave 20 permits a free swinging motion of the lower extremity of the backpack member 12 across the rearward portion of the hips and pelvic portion of the user. In turn, the low friction bearing pads 34 and 36 provide low friction contact with the plate 48 on the rear of the waist-encircling belt, thus preventing any restrictions on the desired side-to-side movement. The swing-limiting belts 38 and 40 prevent the swinging motion of the lower extremity of the backpack member 12 from becoming excessive.

Figure 3:
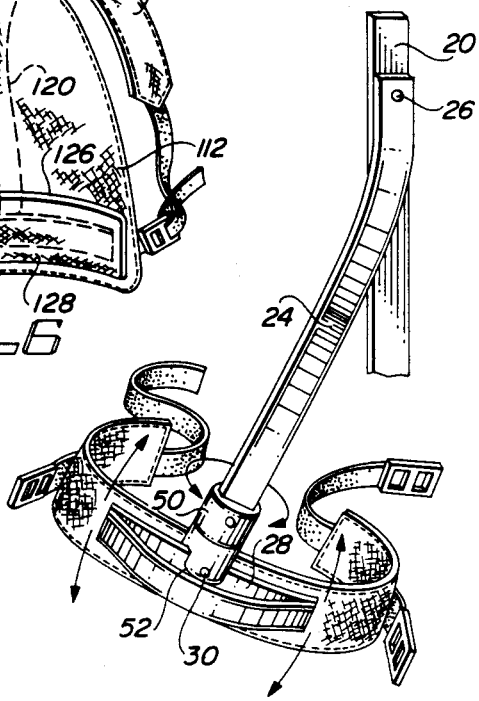
FIG. 3 is an elevation of a portion of a backpack assembly in accordance with the present invention, showing an alternative embodiment to the arrangement shown in FIG. 2.

Reference is now made to FIG. 3, which shows an alternative form of the pivot arm 24. In the arrangement shown in FIG. 3, the pivot arm 24 is provided with a 360° joint defined by members 50 and 52 at the lower extremity of the arm 24. This permits relatively free rotational movement of the waist-encircling belt with respect to the pivot arm 24, thus permitting relatively free movement of the pelvic region as it moves through the relatively complex clockwise and counter-clockwise motions which have been described above.

Figure 4:
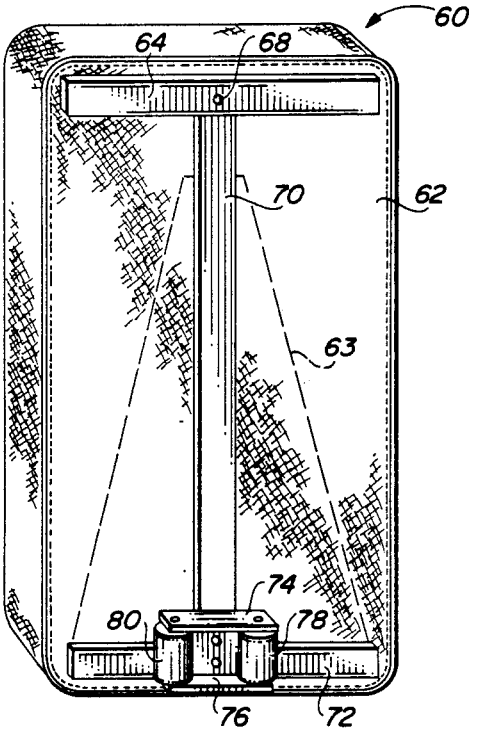
FIG. 4 shows an elevation of a portion of an alternative embodiment of the backpack assembly in accordance with the present invention.

FIG. 4 illustrates another arrangement of a portion of backpack assembly 60 in accordance with the present invention, which arrangement includes a backpack member 62, cross member 64, stave 70 and lower cross member 72 similar in construction to like structural features in FIGS. 1–3. In accordance with the embodiment of FIG. 4 an upper and lower plate 74 and 76, respectively, are attached at or to the lower cross member 72 and support a pair of rollers 78 and 80 which are adapted to provide the low friction contact similar to the teflon bearing pads 34 and 36 of FIG. 1. It will be understood that a belt and pivot arm assembly like that shown in FIGS. 2 and 3 is employed with the arrangement of FIG. 4.

Figure 5A:
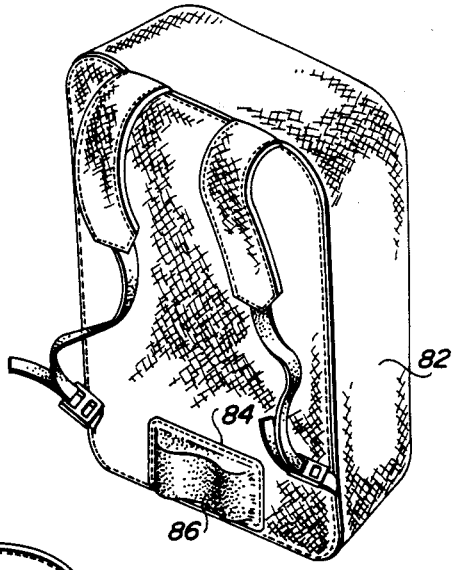
FIGS. 5A and B illustrate an alternative form of a portion of the backpack assembly in accordance with the present invention.
Figure 5B:
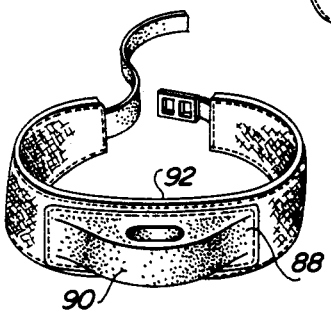

FIGS. 5A and B illustrate yet another embodiment of a portion of the present invention in which a backpack member 82 is provided with a low friction bearing pad 84 having a contoured surface 86 similar in configuration to a curved bearing surface 90 of a bearing pad 88 adapted to be fitted to the rear of the waist-encircling belt 28 in FIG. 1. (Note FIG. 5B.) The bearing pad 88 includes an aperture 92 adapted to receive the lower extremity of the pivot arm 24.

Figure 7:
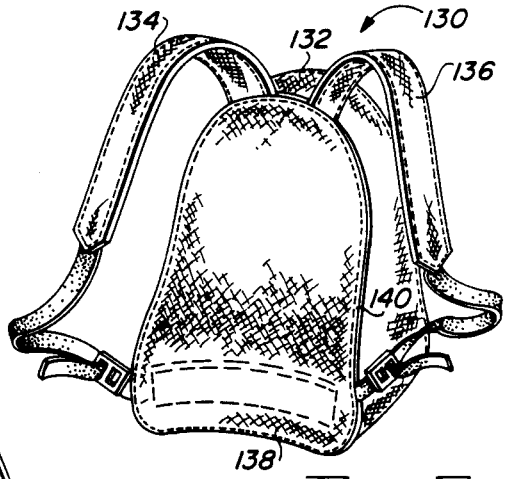
FIG. 7 depicts an alternative arrangement of the backpack assembly in accordance with the present invention, which is similar to the arrangement shown in FIG. 6.
Figure 6:
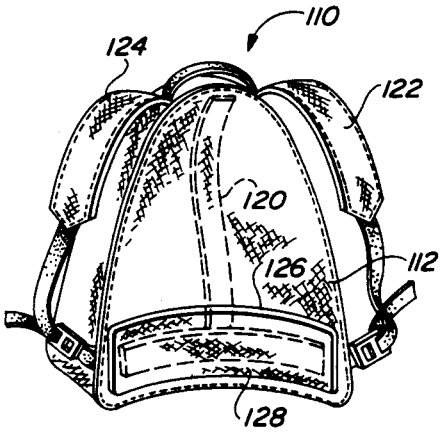
FIG. 6 depicts another alternative form of the backpack assembly in accordance with the present invention.

The embodiment of FIG. 6, referred generally by reference numeral 110, includes shoulder straps 122 and 124 and a vertical stave 20 contoured generally in conformity with the spinal column of the user. The backpack member 112 includes a bearing pad 126 having a bearing surface 128 mounted at the lower extremity of the backpack member 112, in order to provide the desired low friction features described in detail above. FIG. 7 is another embodiment like that of FIG. 6 which omits the vertical stave 120. In FIG. 7, element 130 refers generally to the backpack assembly including a pack 132 and appropriate shoulder straps 134 and 136. The backpack 130 is provided with a molded member 138, the lower portion of which is molded in a protruding concave configuration so as to generally conform to the hip and pelvic region, as is shown in FIG. 7. The member 138 preferably is a low friction material, such as a sheet of polyvinyl chloride which is sewn to the assembly 130 via stitching 140.

Figure 8A:
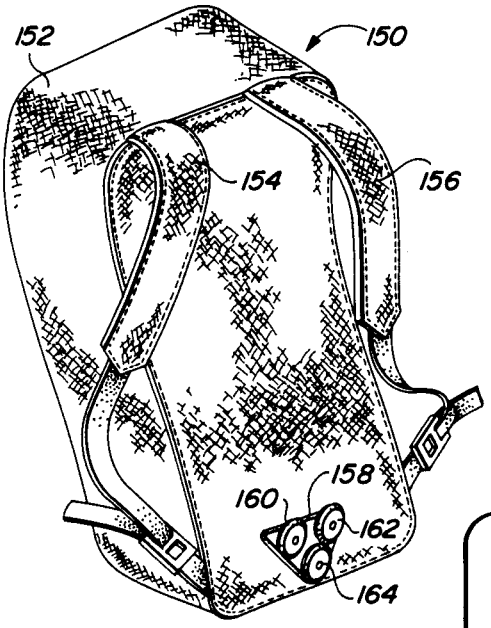
FIGS. 8A, 8B and 8C depict another embodiment of the backpack assembly in accordance with the present invention.
Figure 8C:
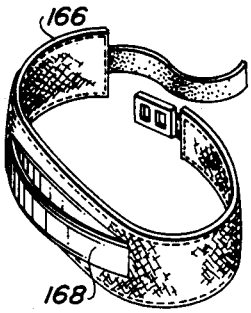
Figure 8B:
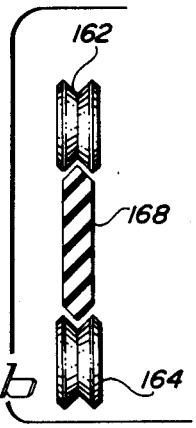

FIGS. 8A, 8B and 8C depict an alternative arrangement of the packback assembly in accordance with the present invention. Referring first to FIG. 8A, the assembly 150 includes a backpack 152 and shoulder straps 154 and 156. In accordance with this embodiment, there is provided a roller assembly along the lower portion of the backpack facing the user, including a roller mounting plate 158 and three rollers 160, 162 and 164 mounted with their respective axes of rotation extending from front to rear with respect to the user. The rollers are arranged in a triangular configuration so that a track 168, described more fully below, extends generally horizontally between the triangular roller arrangement.

Referring now to FIG. 8C, there is provided a waist-encircling belt 166 having a low friction track 168 mounted along the rearward surface thereof and extending away from the belt 166 so as to permit the track to extend horizontally through the three roller system, including rollers 160, 162 and 164 as shown in FIG. 8B. In use, the shoulder straps 154 and 156 are placed around the shoulders of the user, and the belt 166 is engaged around the waist of the user. As the user walks or moves about in a normal manner, the backpack is maintained generally vertically while its weight is transferred to the belt, while the lower portion of the backpack assembly 150 is permitted to move from side to side, and is facilitated in that movement by the motion of the track 168 through the roller system provided by rollers 160, 162 and 164.

Figure 9:
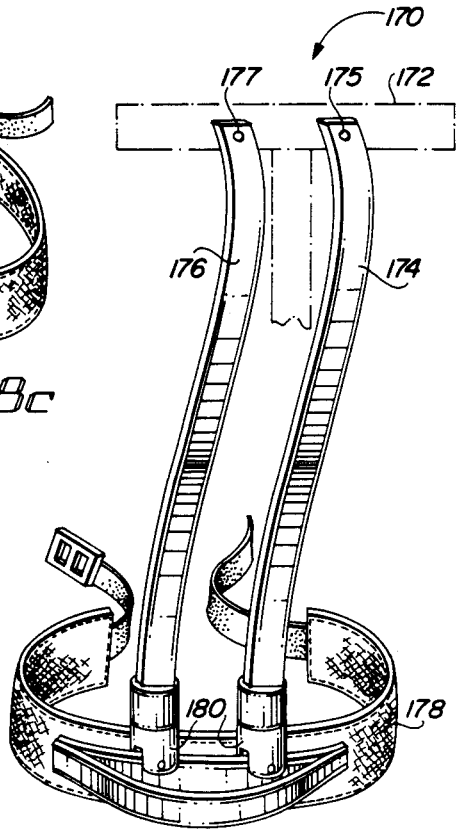
FIG. 9 is an elevation of another form of the portion of the backpack assembly similar to that shown in FIGS. 2 and 3.

FIG. 9 depicts an alternative form of the pivot arm arrangements shown in FIGS. 2 and 3. In the arrangement of FIG. 9, the pivot arm assembly, referred to generally by the reference numeral 170, includes a pair of generally parallel pivot arms 174 and 176 which are connected to a cross member 172 (which serves the same function as the cross member 14 in FIG. 1) at respective pivot points 175 and 177. Each of the pivot arms 174 and 176 is attached to a waist-encircling belt 178 at pivot points 180. The two pivot arms 174 and 176 serve a similar purpose as the pivot arm 24 in FIGS. 1, 2 and 3, but provide further structural stability and support through the use of the dual pivot arm configuration.

It will thus be seen that there are a variety of modifications that can be incorporated into the designs above without departing from the spirit and scope of the present invention.

I claim:

1. A backpack or support assembly adapted to be worn by a user, comprising:

(a) a backpack adapted to be at least partially supported or stabilized by the upper torso of the user;

(b) a belt dimensioned to fit about the waist of the user;

(c) means pivotably coupling said belt with said backpack at or above the center of gravity of said backpack; and wherein (d) the backpack is free to swing from side to side behind the hips of the user and about said pivotal coupling means.

2. The backpack or support assembly recited in claim 1 further comprising shoulder straps attached to said backpack for encircling the shoulders of said user and providing support or stabilization to said backpack.

3. The backpack or support assembly recited in claim 1 wherein said coupling means comprises a pair of generally parallel pivot arms each pivotably coupled at one end to said belt and each pivotably coupled at the other end to said backpack at or above its center of gravity.

4. The backpack or support assembly recited in claim 1 further comprising low friction contact means between said backpack and the hip area of said user, in order to permit said side to side movement.

5. The backpack or support assembly recited in claim 4 wherein said low friction contact means comprises a bearing surface between said backpack and said waist-encircling belt.

6. The backpack or support assembly recited in claim 4 further comprising means for limiting the side-to-side swing of said backpack across the hip area of said user.

7. The backpack or support assembly recited in claim 6 wherein said swing-limiting means comprises an elastic belt between said backpack and said user.

8. The backpack or support assembly recited in claim 1 wherein said coupling means comprises a pivot arm pivotably coupled at one end to said waist-encircling belt and pivotably coupled at the other end to said backpack at or above its center of gravity.

9. The backpack or support assembly recited in claim 8 further comprising means along said pivot arm for permitting axial rotation of a portion of said arm and said waist-encircling belt with respect to the remainder of said arm pivotably coupled to said backpack.

10. The backpack or support assembly recited in claim 8 further comprising means for extending said pivot arm in order to accommodate changes in the dimension between said belt and said pivot point.

11. The backpack or support assembly recited in claim 10 wherein said extending means comprises a track along said pivot arm.

12. The backpack or support assembly recited in claim 8 further comprising a vertical stave extending along said backpack and oriented so as to be generally parallel with the spine of the user when resting on the back of the user, said arm pivoted to said backpack along said stave.

13. The backpack or support assembly recited in claim 12 wherein said pivot arm and said stave are curved to orthopedically conform generally to the curve of the spine of the user.

14. The backpack or support assembly recited in claim 12 further comprising a cross member across the top of said stave for supporting said backpack.

15. The backpack or support assembly recited in claim 12 further comprising a bearing pad along the bottom of said stave and having means providing a low friction contact with said waist-encircling belt.

16. The backpack or support assembly recited in claim 15 further comprising means for restricting said side-to-side swing of said backpack relative to the hips of the user.

17. A back carrier assembly comprising:

(a) a carrier adapted to be carried across the back of the user, said carrier having an upper portion adjacent the upper torso of the user and a lower portion adjacent the waist and pelvic area of the user, when said carrier is being worn;

(b) means for supporting said upper portion of said carrier relatively immobile with the upper torso of the user;

(c) means for coupling said carrier at a point at or above the center of gravity of said carrier, and with said lower portion of said carrier relatively free to move in a side to side motion across the hips of the user; and (d) low friction means between said lower portion of said carrier and the waist and hip area of the user.

18. The back carrier assembly recited in claim 17 wherein said supporting and coupling means comprises shoulder straps at the upper portion of said carrier.

19. The back carrier assembly recited in claim 17 wherein said low friction means includes means mounted on the lower portion of said carrier.

20. The back carrier assembly recited in claim 19 wherein said low friction means mounted on the lower portion of said carrier comprises low friction bearing pads.

21. The back carrier assembly recited in claim 19 wherein said low friction means mounted on the lower portion of said carrier comprises a roller system.

22. The back carrier assembly recited in claim 19 wherein said low friction means mounted on the lower portion of said carrier comprises a low friction surface along said lower portion.

23. The back carrier assembly recited in claim 17 wherein said carrier has a concave portion adjacent the hips and pelvic region of the user, said concave portion generally conforming to that hip and pelvic region during said side to side motion.

24. The back carrier assembly recited in claim 23 wherein said low friction means comprises a low friction material along the surface of said concave portion.

25. The back carrier assembly recited in claim 24 wherein said concave portion comprises a molded member sewn to said assembly.

26. A back carrier assembly comprising:

(a) a carrier adapted to be carried across the back of the user, said carrier having an upper portion adapted to be worn adjacent the upper torso of the user and a lower portion adapted to be worn adjacent the waist and pelvic area of the user, when said carrier is being worn;

(b) shoulder strap means for engaging the upper torso of the user;

(c) a belt dimensioned to fit about the waist of the user;

(d) a roller system mounted between the lower portion of said carrier assembly and said belt; and wherein (e) said roller system comprises a track mounted on the rearward surface of the belt and at least a pair of opposing rollers for engaging said track, said rollers mounted along the lower portion of said carrier.

27. The back carrier assembly recited in claim 26 further comprising a third roller with said roller assembly on said lower portion of said carrier.

* * * * *